US009646467B2

(12) United States Patent
Wan

(10) Patent No.: US 9,646,467 B2
(45) Date of Patent: May 9, 2017

(54) INTELLIGENT ELECTRONIC HORN AND IMPLEMENTATION METHOD THEREOF

(71) Applicant: Yu Wan, Heilongjiang (CN)

(72) Inventor: Yu Wan, Heilongjiang (CN)

( * ) Notice: Subject to any disclaimer, the term of this patent is extended or adjusted under 35 U.S.C. 154(b) by 0 days.

(21) Appl. No.: 14/421,588

(22) PCT Filed: Aug. 8, 2013

(86) PCT No.: PCT/CN2013/081062
§ 371 (c)(1),
(2) Date: Feb. 13, 2015

(87) PCT Pub. No.: WO2014/026565
PCT Pub. Date: Feb. 20, 2014

(65) Prior Publication Data

US 2015/0221188 A1 Aug. 6, 2015

(30) Foreign Application Priority Data

Aug. 16, 2012 (CN) ..... 2012 1 0291323

(51) Int. Cl.
*G08B 3/10* (2006.01)
*G10K 9/12* (2006.01)

(52) U.S. Cl.
CPC *G08B 3/10* (2013.01); *G10K 9/12* (2013.01)

(58) Field of Classification Search
CPC ..... G08B 3/10; G10K 9/12; H03F 2200/351
(Continued)

(56) References Cited

U.S. PATENT DOCUMENTS 5,160,913 A * 11/1992 Yoon ..... B06B 1/0223 340/384.71
5,266,921 A * 11/1993 Wilson ..... B06B 1/023 116/142 R (Continued)

FOREIGN PATENT DOCUMENTS

CN 2870076 Y 2/2007
CN 101934758 A 1/2011

(Continued)

OTHER PUBLICATIONS

International Search Report (PCT/ISA/210) mailed on Nov. 21, 2013, by the Chinese Patent Office as the International Searching Authority for International Application No. PCT/CN2013/081062.

*Primary Examiner* — Don N Vo
(74) *Attorney, Agent, or Firm* — Buchanan Ingersoll & Rooney PC

(57) ABSTRACT

An intelligent electronic horn and an implementation method includes: detecting one or more of a current operating air pressure, operating temperature and power supply voltage of the electronic horn; calculating a compensation control parameter according to a detection result; performing compensation control on a drive signal of the electronic horn according to the compensation control parameter; and using the drive signal after the compensation control to drive the electronic horn to sound. The operating air pressure, temperature and power supply voltage of an electronic horn are detected, calculations are performed on the basis of a pre-established mathematical model according to detected values, and compensation control is performed on the frequency and pulse width of a drive signal of the electronic horn.

10 Claims, 2 Drawing Sheets

(58) Field of Classification Search
USPC ..... 340/384.7
See application file for complete search history.

(56) References Cited

U.S. PATENT DOCUMENTS

| | | | | | |
|---|---|---|---|---|---|
| 5,293,149 | A * | 3/1994 | Wilson | G08B 3/10 | 340/384.73 |
| 5,414,406 | A * | 5/1995 | Baxter | G08B 3/10 | 116/142 R |
| 6,456,193 | B1 * | 9/2002 | Wan | B60Q 5/00 | 116/137 R |
| 7,447,318 | B2 | 11/2008 | Button et al. | | |
| 2002/0118841 | A1 | 8/2002 | Button et al. | | |
| 2002/0167354 | A1 * | 11/2002 | Stanley | H03F 3/2175 | 330/10 |
| 2007/0096801 | A1 * | 5/2007 | Shimizu | H03F 1/0211 | 330/10 |

FOREIGN PATENT DOCUMENTS

| | | | |
|---|---|---|---|
| CN | 202524544 | U | 11/2012 |
| CN | 202799086 | U | 3/2013 |
| CN | 103151035 | A | 6/2013 |
| JP | 2009-101895 | A | 5/2009 |

* cited by examiner

INTELLIGENT ELECTRONIC HORN AND IMPLEMENTATION METHOD THEREOF

BACKGROUND

Technical Field

The present invention relates to the field of electronic horns for motor vehicles and boats, and in particular, to an intelligent electronic horn and an implementation method thereof.

Related Art

As electronic horns have rapidly gained popularity, increasingly higher requirements are imposed on the service life and operating stability of horns. Besides the waterproof performance of the horn and diaphragm breakage, other factors affecting the normal operation of the horn mainly include the follow three aspects: the effect of the change in power supply on the sound level and service life of the horn; the effect of the change in temperature on the sound level and sound quality of the horn; and the effect of the change in air pressure on the sound level of the horn. Although a variety of improvement methods have been proposed in recent years, neither of these methods provides a complete solution for all the three failure modes of the electronic horn.

The frequency of a conventional electronic horn usually cannot be changed after delivery and commissioning. Due to the effect of ambient temperature or air pressure on the spiral sound channel of the electronic horn, there is a relatively large change in the resonance frequency of the spiral resonant cavity of the horn, leading to a relatively large attenuation of the sound pressure level of the horn. Therefore, for many horns, when used in high temperature environments, the resonance frequency of the horn drifts to a lower frequency due to the effect of the change in temperature on the air density and the volume of the resonant cavity. For many horns, when used in low temperature environments, the resonance frequency of the horn drifts to a higher frequency due to the effect of the change in temperature on the air density and the volume of the resonant cavity. If the atmospheric pressure decreases as the altitude increases, the fundamental frequencies of the spiral resonant cavity of the electronic horn and a drive circuit also greatly deviate, causing that the sound pressure level of the horn is significantly attenuated, and the horn can no longer operate normally.

Generally, the driving power of electric horns for motor vehicles and boats, either of mechanical or electronic type, varies greatly due to the power supply voltage. For example, electric horns are required to operate at a voltage of 9-16 V, and the power of a horn with a rated voltage of 13 V and a rated operating current of 4 A changes significantly in the range of 25 W to 79 W. This has great impacts on the service life and sound effect of the horn, and easily leads to a significant attenuation of the sound level at a low voltage and leads to noise caused by collision (also called striking) between movable and fixed cores of an electromagnet that drives the diaphragm of the horn to sound at a high voltage. This phenomenon not only deteriorates the sound quality but also greatly shortens the service life of the horn. Although there are approaches of reducing the current by means of constant current source driving or by using an analog device to reduce the drive pulse width, the driving power cannot be accurately controlled, and occurrence of such failure modes cannot be eliminated.

SUMMARY

Accordingly, the present invention is directed to an intelligent electronic horn that can overcome the abovementioned defects and an implementation method thereof.

A first aspect of the present invention provides an implementation method of an intelligent electronic horn, including: detecting one or more of a current operating air pressure, operating temperature and power supply voltage of the electronic horn; calculating a compensation control parameter according to a detection result; performing compensation control on a drive signal of the electronic horn according to the compensation control parameter; and using the drive signal after the compensation control to drive the electronic horn to sound.

A second aspect of the present invention provides an intelligent electronic horn, including: a detection module, configured to detect one or more of a current operating air pressure, operating temperature and power supply voltage of the electronic horn; a calculation module, configured to calculate a compensation control parameter according to a detection result; and a compensation control module, configured to perform compensation control on a drive signal of the electronic horn according to the compensation control parameter, and use the drive signal after the compensation control to drive the electronic horn to sound.

In the present invention, the operating air pressure, temperature and power supply voltage of an electronic horn are detected, calculations are performed on the basis of a pre-established mathematical model according to detected values, and compensation control is performed on the frequency and pulse width of a drive signal of the electronic horn; whereby, the electronic horn can be driven by using a power that is suitable for the current environment of the electronic horn in the case of varying air pressure and temperature, thereby achieving an almost identical optimal sound effect under different environmental conditions.

DETAILED DESCRIPTION

The technical solutions of the present invention are described in further detail with reference to the accompanying drawings and embodiments.

Figure 1:
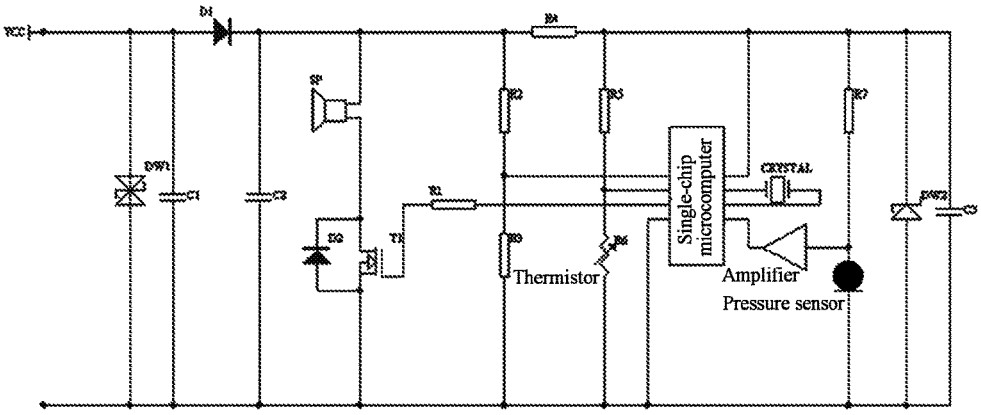
FIG. 1 is a circuit diagram of an intelligent electronic horn according to an embodiment of the present invention.

FIG. 1 is a circuit diagram of an intelligent electronic horn according to an embodiment of the present invention.

As shown in FIG. 1, the circuit diagram of this embodiment includes a power supply part, a power amplification part, a horn drive signal compensation control part, a sound pressure level sensing part, a temperature sensing part and a power supply voltage detection part.

The power supply part includes a series voltage regulating circuit consisting of a reverse polarity protection diode D1, a current limiting resistor R4, and a voltage regulating diode DW2. The anode of the reverse polarity protection diode D1 is connected to the positive terminal VCC of a power supply, and the cathode of the reverse polarity protection diode D1 is connected to the current limiting resistor R4. A capacitor C3 is connected in parallel with the voltage regulating diode DW2, and thus is connected between the negative terminal of the power supply and the current limiting resistor, so as to provide a stable voltage. It should be understood by a person of ordinary skill in the art that the power supply part may also use other types of voltage regulating circuits.

The power amplification part includes a field effect transistor T1. The gate of the field effect transistor T1 is connected to a signal output end of a single-chip microcomputer, and is used for receiving a drive signal of an electronic horn that is output by the single-chip microcomputer. The source of the field effect transistor T1 is connected to the negative terminal of the power supply. A diode D2 is connected between the drain and source of the field effect transistor T1. The anode of the diode D2 is connected to the source of the field effect transistor T1. An electronic horn SP is connected between the drain of the field effect transistor T1 and the cathode of the diode D1. It should be understood by a person of ordinary skill in the art that the power amplification part may be implemented by electronic parts and components including transistors, field effect transistors, and insulated-gate bipolar transistors (IGBT). A signal output from the single-chip microcomputer is amplified by the field effect transistor T1 and then applied to the electronic horn, to drive the electronic horn to sound.

The air pressure sensing part includes a pressure sensor and an amplifier that are connected in series, and has one end connected to the negative terminal of the power supply and the other end connected to an input end of the amplifier, an output end of the amplifier being connected to the single-chip microcomputer.

The power supply voltage detection part includes resistors R2 and R3, which are connected in series between the cathode of the diode D1 and the negative terminal of the power supply, and used for dividing the power supply voltage of the horn.

The temperature sensing part includes a resistor R5 and a thermistor R6 that are connected in series, one end of the resistor R5 being connected to the cathode of the diode DW1 by the resistor R4, the other end of the resistor R5 being connected to the thermistor R6, and the other end of the thermistor R6 being connected to the negative terminal of the power supply.

The compensation control part may be implemented by using a single-chip microcomputer, and is used for performing compensation control on the drive signal of the electronic horn. One pin of the single-chip microcomputer is connected between the resistors R2 and R3, another pin of the single-chip microcomputer is connected between the resistor R5 and the thermistor R6, and still another pin of the single-chip microcomputer is connected to the output end of the amplifier of the air pressure sensing part. The single-chip microcomputer respectively receives signals from the air pressure sensing part, the temperature sensing part and the power supply voltage detection part, calculates a compensation control parameter for the drive signal of the electronic horn, and performs compensation control on the drive signal of the horn. The single-chip microcomputer further includes a signal generating unit, for generating the drive signal of the electronic horn.

In one aspect, an air pressure signal detected by the pressure sensor is amplified by the amplifier and then input to the single-chip microcomputer, and is A/D converted and sent to a memory in the single-chip microcomputer. The single-chip microcomputer calculates an ideal frequency and an ideal pulse width of the drive signal of the electronic horn at the current operating air pressure on the basis of a pre-established mathematical model correlated to the operating air pressure, a drive signal frequency and a drive signal pulse width of the electronic horn, and stores the ideal frequency and the ideal pulse width to the memory. Specifically, a frequency and a pulse width of the drive signal of the electronic horn at the standard operating air pressure at zero altitude may be provided in advance, where the frequency and the pulse width satisfy a condition of the pre-established mathematical model correlated to the operating air pressure, the drive signal frequency and the drive signal pulse width of the electronic horn, and then the ideal frequency and the ideal pulse width of the drive signal of the electronic horn are calculated according to the current operating air pressure of the electronic horn.

In another aspect, after voltage division by the resistors R5 and R6, an electrical signal is A/D converted in the single-chip microcomputer and then sent to the memory in the single-chip microcomputer. R6 is a thermistor, and therefore its resistance changes with ambient temperature. The current operating temperature of the electronic horn can be calculated according to the value after A/D conversion, the resistances of the resistors R5 and R6 and operating parameters of R6. The single-chip microcomputer calculates an ideal frequency and an ideal pulse width of the drive signal of the electronic horn at the current operating temperature according to the current operating temperature of the electronic horn and on the basis of a pre-established temperature-frequency-pulse width mathematical model, and stores the ideal frequency and the ideal pulse width to the memory.

In still another aspect, after voltage division by R2 and R3, an electrical signal is A/D converted in the single-chip microcomputer and then sent to the memory in the single-chip microcomputer. The value of the current power supply voltage of the electronic horn can be calculated according to the value after A/D conversion and the resistances of the voltage dividing resistors R2 and R3. The single-chip microcomputer calculates an ideal pulse width of the drive signal of the electronic horn at the current operating voltage according to the value of the current power supply voltage of the electronic horn and on the basis of a mathematical model correlated to the power supply voltage of the electronic horn and a constant driving power. The constant driving power is preset and stored in the memory of the single-chip microcomputer, and may be a rated power of the electronic horn.

The single-chip microcomputer performs frequency adjustment and pulse width adjustment on the drive signal of the electronic horn according to one or more of the calculation results obtained in the foregoing three aspects, then performs power amplification on the drive signal, and uses the drive signal after the power amplification to drive the electronic horn to sound. There may be various choices and combinations for the adjustment of the frequency and pulse width of the drive signal according to the calculation results. For example, the drive signal frequency of the electronic horn is adjusted according to the ideal frequency at the operating air pressure, and then pulse width adjustment is performed on the drive signal after the frequency adjustment according to the ideal pulse width at the operating air pressure; or the drive signal frequency of the electronic horn is adjusted according to the ideal frequency at the operating temperature, and then pulse width adjustment is performed on the drive signal after the frequency adjustment according to the ideal pulse width at the operating temperature; or pulse width adjustment is performed on the drive signal according to the ideal pulse width at the power supply voltage; or the drive signal frequency of the electronic horn is adjusted according to the ideal frequency at the operating air pressure and the ideal frequency at the operating temperature, and then pulse width adjustment is performed on the drive signal after the frequency adjustment according to the ideal pulse width at the operating air pressure and the ideal pulse width at the operating temperature; or the drive signal frequency of the electronic horn is adjusted according to the ideal frequency at the operating air pressure, and then pulse width adjustment is performed on the drive signal after the frequency adjustment according to the ideal pulse width at the operating air pressure and the ideal pulse width at the power supply voltage; or the drive signal frequency of the electronic horn is adjusted according to the ideal frequency at the operating temperature, and then pulse width adjustment is performed on the drive signal after the frequency adjustment according to the ideal pulse width at the operating temperature and the ideal pulse width at the power supply voltage; or the drive signal frequency of the electronic horn is adjusted according to the ideal frequency at the operating air pressure and the ideal frequency at the operating temperature, and then pulse width adjustment is performed on the drive signal after the frequency adjustment according to the ideal pulse width at the operating air pressure, the ideal pulse width at the operating temperature and the ideal pulse width at the power supply voltage. Finally, the electronic horn can be driven by using a signal power that is most suitable for the current environment of the electronic horn in the case of varying air pressure and temperature, thereby achieving an almost identical optimal sound effect under different environmental conditions.

Figure 2:
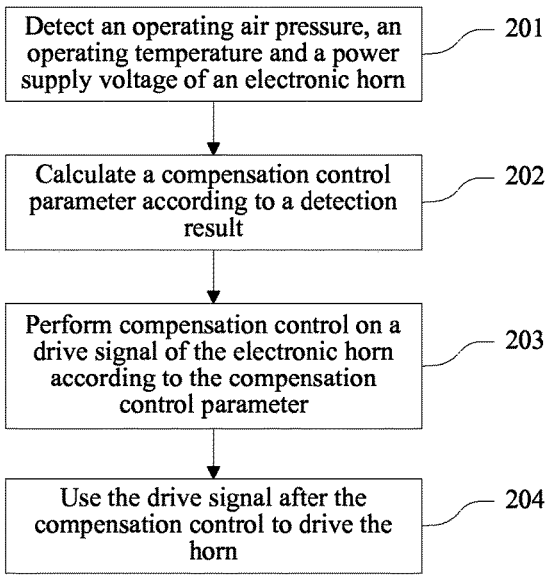
FIG. 2 is a flowchart of an implementation method of an intelligent electronic horn according to an embodiment of the present invention.

FIG. 2 is a flowchart of an implementation method of an intelligent electronic horn according to an embodiment of the present invention.

Step 201: Detect a current operating air pressure, operating temperature and power supply voltage of the electronic horn. The air pressure may be detected by using a pressure sensor disposed in the vicinity of the electronic horn, and amplified by the amplifier and then input to a single-chip microcomputer. Detection of the operating temperature and the power supply voltage of the electronic horn may be implemented by using various circuit structures, where the detection of the operating temperature may be implemented by using a thermistor, and the detection of the power supply voltage may be implemented by directly using a voltage dividing resistor. After an voltage-divided electrical signal is obtained from the circuit of the electronic horn, the voltage-divided electrical signal is A/D converted into a digital signal, and then the current operating temperature and the power supply voltage of the electronic horn can be calculated according to the digital signal and a known condition related to the electrical signal in the circuit. In another embodiment of the present invention, one or more of the current operating air pressure, operating temperature and power supply voltage of the electronic horn may be detected.

Step 202: Calculate a compensation control parameter for the drive signal of the electronic horn according to a detection result.

The single-chip microcomputer calculates an ideal frequency and an ideal pulse width of the drive signal of the electronic horn at the current operating air pressure according to the current operating air pressure of the electronic horn and on the basis of a pre-established mathematical model correlated to the operating air pressure, a drive signal frequency and a drive signal pulse width of the electronic horn. The single-chip microcomputer calculates an ideal frequency and an ideal pulse width of the drive signal of the electronic horn at the current operating temperature according to the current operating temperature of the electronic horn and on the basis of a pre-established temperature-frequency-pulse width mathematical model. The single-chip microcomputer calculates an ideal pulse width of the drive signal of the electronic horn at the current operating voltage according to the current power supply voltage of the electronic horn and on the basis of a pre-established mathematical model correlated to the power supply voltage of the electronic horn and a constant driving power. The above calculation results may be stored in a memory of the single-chip microcomputer. It should be understood that one or more of the foregoing calculations may be performed.

Step 203: Perform compensation control on the drive signal of the electronic horn according to the compensation control parameter. It should be understood that compensation control may be performed on the drive signal according to one or more of the compensation control parameters. For example, the drive signal frequency of the electronic horn is adjusted according to the ideal frequency at the operating air pressure, and then pulse width adjustment is performed on the drive signal after the frequency adjustment according to the ideal pulse width at the operating air pressure; or the drive signal frequency of the electronic horn is adjusted according to the ideal frequency at the operating temperature, and then pulse width adjustment is performed on the drive signal after the frequency adjustment according to the ideal pulse width at the operating temperature; or pulse width adjustment is performed on the drive signal according to the ideal pulse width at the power supply voltage; or the drive signal frequency of the electronic horn is adjusted according to the ideal frequency at the operating air pressure and the ideal frequency at the operating temperature, and then pulse width adjustment is performed on the drive signal after the frequency adjustment according to the ideal pulse width at the operating air pressure and the ideal pulse width at the operating temperature; or the drive signal frequency of the electronic horn is adjusted according to the ideal frequency at the operating air pressure, and then pulse width adjustment is performed on the drive signal after the frequency adjustment according to the ideal pulse width at the operating air pressure and the ideal pulse width at the power supply voltage; or the drive signal frequency of the electronic horn is adjusted according to the ideal frequency at the operating temperature, and then pulse width adjustment is performed on the drive signal after the frequency adjustment according to the ideal pulse width at the operating temperature and the ideal pulse width at the power supply voltage; or the drive signal frequency of the electronic horn is adjusted according to the ideal frequency at the operating air pressure and the ideal frequency at the operating temperature, and then pulse width adjustment is performed on the drive signal after the frequency adjustment according to the ideal pulse width at the operating air pressure, the ideal pulse width at the operating temperature and the ideal pulse width at the power supply voltage.

Step 204: Use the drive signal after the compensation control to drive the electronic horn to sound. Finally, the electronic horn can be driven by using a signal power that is most suitable for the current environment of the electronic horn in the case of varying air pressure and temperature, thereby achieving an almost identical optimal sound effect under different environmental conditions.

Figure 3:
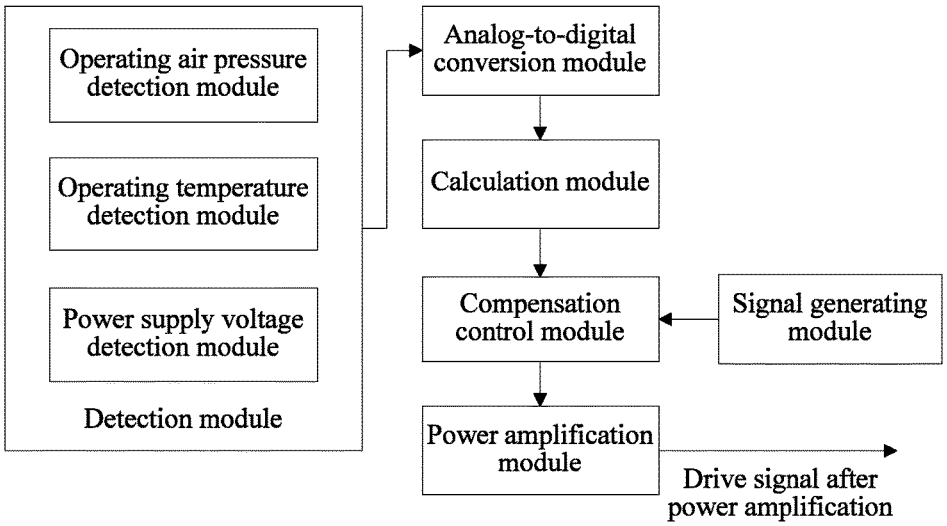
FIG. 3 is a schematic structural diagram of an intelligent electronic horn according to an embodiment of the present invention.

FIG. 3 is a schematic structural diagram of an intelligent electronic horn according to an embodiment of the present invention.

As shown in FIG. 3, the intelligent electronic horn according to the present invention includes a detection module, an analog-to-digital conversion module, a calculation module, a compensation control module, a signal generating module and a power amplification module. The detection module includes an operating air pressure detection module, an operating temperature detection module and a power supply voltage detection module.

The detection module is configured to detect a current operating air pressure, operating temperature and power supply voltage of the electronic horn. These operations are respectively completed by sub-modules of the detection module, namely, the operating air pressure detection module, the operating temperature detection module and the power supply voltage detection module. It should be understood that the detection module may include one or more of the above sub-modules to perform one or more of the above detections.

A detection result is sent to the analog-to-digital conversion module, and converted by the analog-to-digital conversion module into a digital signal.

The calculation module calculates a compensation control parameter according to the digital signal of the detection result, and then sends the compensation control parameter to the compensation control module. The calculation module includes three sub-modules, which are respectively configured to: calculate an ideal frequency and an ideal pulse width of the drive signal of the electronic horn at the current operating air pressure according to the current operating air pressure of the electronic horn and on the basis of a pre-established mathematical model correlated to the operating air pressure, a drive signal frequency and a drive signal pulse width of the electronic horn; calculate an ideal frequency and an ideal pulse width of the drive signal of the electronic horn at the current operating temperature according to the current operating temperature of the electronic horn and on the basis of a pre-established temperature-frequency-pulse width mathematical model; and calculate an ideal pulse width of the drive signal of the electronic horn at the current operating voltage according to the current power supply voltage of the electronic horn and on the basis of a mathematical model correlated to the power supply voltage of the electronic horn and a constant driving power. It should be understood that the calculation module may include one or more of the above-mentioned sub-modules to calculate one or more compensation control parameters.

The compensation control module performs, according to the compensation control parameter, compensation control on the drive signal of the electronic horn that is generated by the signal generating module. It should be understood that compensation control may be performed on the drive signal according to one or more of the above compensation control parameters. Therefore, the compensation control module may include one of the following sub-modules, which sub-modules are respectively configured to: adjust the drive signal frequency of the electronic horn according to the ideal frequency at the operating air pressure, and then perform pulse width adjustment on the drive signal after the frequency adjustment according to the ideal pulse width at the operating air pressure; or adjust the drive signal frequency of the electronic horn according to the ideal frequency at the operating temperature, and then perform pulse width adjustment on the drive signal after the frequency adjustment according to the ideal pulse width at the operating temperature; or perform pulse width adjustment on the drive signal according to the ideal pulse width at the power supply voltage; or the drive signal frequency of the electronic horn according to the ideal frequency at the operating air pressure and the ideal frequency at the operating temperature, and then perform pulse width adjustment on the drive signal after the frequency adjustment according to the ideal pulse width at the operating air pressure and the ideal pulse width at the operating temperature; or adjust the drive signal frequency of the electronic horn according to the ideal frequency at the operating air pressure, and then perform pulse width adjustment on the drive signal after the frequency adjustment according to the ideal pulse width at the operating air pressure and the ideal pulse width at the power supply voltage; or adjust the drive signal frequency of the electronic horn according to the ideal frequency at the operating temperature, and then perform pulse width adjustment on the drive signal after the frequency adjustment according to the ideal pulse width at the operating temperature and the ideal pulse width at the power supply voltage; or adjust the drive signal frequency of the electronic horn according to the ideal frequency at the operating air pressure and the ideal frequency at the operating temperature, and then perform pulse width adjustment on the drive signal after the frequency adjustment according to the ideal pulse width at the operating air pressure, the ideal pulse width at the operating temperature and the ideal pulse width at the power supply voltage At last, the power amplification module performs power amplification on the drive signal after the compensation control and uses the drive signal after the power amplification to drive the electronic horn to sound. Finally, the electronic horn can be driven by using a signal power that is most suitable for the current environment of the electronic horn in the case of varying air pressure and temperature, thereby achieving an almost identical optimal sound effect under different environmental conditions.

The digital signal obtained through conversion of the analog-to-digital conversion module and the compensation control parameter calculated by the calculation module may be stored in the memory, so as to respectively provide values required by the calculation module for calculation and provide the compensation control parameters required by the compensation control module for compensation control.

A person skilled in the art should also be aware that the units and algorithm steps of the examples described with reference to the embodiments disclosed in this specification may be implemented by electronic hardware, computer software, or a combination thereof. To clearly describe the interchangeability between hardware and software, the foregoing has generally described the composition and steps of each embodiment according to functions. Whether these functions are performed by hardware or software depends on particular applications and design constraint conditions of the technical solutions. A person skilled in the art may use different methods to implement the described functions for each particular application, but such implementations should not be construed as departing from the scope of the present invention.

The steps of the methods or algorithms described with reference to the embodiments disclosed in this specification may be implemented by hardware, a processor-executable software module, or a combination thereof. The software module may reside in a random access memory (RAM), internal memory, a read-only memory (ROM), an electrically programmable ROM, an electrically erasable programmable ROM, a registers, a hard disk, a removable disk, a CD-ROM, or any other form of storage medium known in the art.

Although the objectives, the technical solutions and beneficial effects of the present invention are described in further detail with reference to the above specific embodiments, it should be understood that the foregoing descriptions are merely specific embodiments of the present invention, but are not intended to limit the protection scope of the present invention, and any modification, equivalent replacement or improvement made within the spirit and principle of the present invention shall fall within the protection scope of the present invention.

What is claimed is:

1. An implementation method of an intelligent electronic horn for a vehicle, the electronic horn having a resonant frequency, and the method comprising:

detecting one or more of a current operating air pressure, operating temperature and power supply voltage of the electronic horn;

calculating a compensation control parameter according to a detection result;

performing compensation control on a drive signal of the electronic horn according to the compensation control parameter so that a frequency of the driving signal is changed to be consistent with the resonant frequency of the electronic horn; and using the drive signal after the compensation control to drive the electronic horn to sound.

2. The method according to claim 1, wherein the step of calculating a compensation control parameter according to a detection result comprises one or more of the following steps:

calculating a first frequency and a first pulse width of the drive signal of the electronic horn at the current operating air pressure according to the operating air pressure, wherein the first frequency and the first pulse width satisfy a condition of a pre-established mathematical model correlated to the operating air pressure, a drive signal frequency and a drive signal pulse width of the electronic horn;

calculating a second frequency and a second pulse width of the drive signal of the electronic horn at the current operating temperature according to the operating temperature, wherein the second frequency and the second pulse width satisfy a condition of a pre-established mathematical model correlated to the operating temperature, the drive signal frequency and the drive signal pulse width of the electronic horn; and calculating a third pulse width of the drive signal of the electronic horn at the current power supply voltage according to the power supply voltage, wherein the third pulse width satisfies a condition of a pre-established mathematical model correlated to the power supply voltage of the electronic horn and a preset constant driving power.

3. The method according to claim 2, wherein the step of performing compensation control on a drive signal of the electronic horn according to the compensation control parameter comprises:

adjusting the drive signal frequency of the electronic horn according to the first frequency, and then performing pulse width adjustment on the drive signal after the frequency adjustment according to the first pulse width; or adjusting the drive signal frequency of the electronic horn according to the second frequency, and then performing pulse width adjustment on the drive signal after the frequency adjustment according to the second pulse width; or performing pulse width adjustment on the drive signal of the electronic horn according to the third pulse width; or adjusting the drive signal frequency of the electronic horn according to the first frequency and the second frequency, and then performing pulse width adjustment on the drive signal after the frequency adjustment according to the first pulse width and the second pulse width; or adjusting the drive signal frequency of the electronic horn according to the first frequency, and then performing pulse width adjustment on the drive signal after the frequency adjustment according to the first pulse width and the third pulse width; or adjusting the drive signal frequency of the electronic horn according to the second frequency, and then performing pulse width adjustment on the drive signal after the frequency adjustment according to the second pulse width and the third pulse width; or adjusting the drive signal frequency of the electronic horn according to the first frequency and the second frequency, and then performing pulse width adjustment on the drive signal after the frequency adjustment according to the first pulse width, the second pulse width and the third pulse width.

4. The method according to claim 1, wherein the step of using the drive signal after the compensation control to drive the electronic horn to sound comprises:

performing power amplification on the drive signal after the compensation control, and using the drive signal after the power amplification to drive the electronic horn to sound.

5. An intelligent electronic horn for a vehicle, the electronic horn having a resonant frequency and comprising:

a detection module, configured to detect one or more of a current operating air pressure, operating temperature and power supply voltage of the electronic horn;

a calculation module, configured to calculate a compensation control parameter according to a detection result; and a compensation control module, configured to perform compensation control on a drive signal of the electronic horn according to the compensation control parameter so that a frequency of the driving signal is changed to be consistent with the resonant frequency of the electronic horn, and use the drive signal after the compensation control to drive the electronic horn to sound.

6. The intelligent electronic horn according to claim 5, wherein the detection module comprises one or more of the following modules:

an operating air pressure detection module, configured to detect the current operating air pressure of the electronic horn;

an operating temperature detection module, configured to detect the current operating temperature of the electronic horn; and a power supply voltage detection module, configured to detect the current power supply voltage of the electronic horn.

7. The intelligent electronic horn according to claim 5, wherein the calculation module comprises one or more of the following modules:

a module configured to calculate a first frequency and a first pulse width of the drive signal of the electronic horn at the current operating air pressure according to the operating air pressure, wherein the first frequency and the first pulse width satisfy a condition of a pre-established mathematical model correlated to the operating air pressure, a drive signal frequency and a drive signal pulse width of the electronic horn;

a module configured to calculate a second frequency and a second pulse width of the drive signal of the electronic horn at the current operating temperature according to the operating temperature, wherein the second frequency and the second pulse width satisfy a condition of a pre-established mathematical model correlated to the operating temperature the drive signal frequency, and drive signal pulse width of the electronic horn; and a module configured to calculate a third pulse width of the drive signal of the electronic horn at the current power supply voltage according to the power supply voltage, wherein the third pulse width satisfies a condition of a pre-established mathematical model correlated to the power supply voltage of the electronic horn and a preset constant driving power.

8. The intelligent electronic horn according to claim 7, wherein the compensation control module comprises:

a module configured to adjust the drive signal frequency of the electronic horn according to the first frequency, and then perform pulse width adjustment on the drive signal after the frequency adjustment according to the first pulse width; or a module configured to adjust the drive signal frequency of the electronic horn according to the second frequency, and then perform pulse width adjustment on the drive signal after the frequency adjustment according to the second pulse width; or a module configured to perform pulse width adjustment on the drive signal of the electronic horn according to the third pulse width; or a module configured to adjust the drive signal frequency of the electronic horn according to the first frequency and the second frequency, and then perform pulse width adjustment on the drive signal after the frequency adjustment according to the first pulse width and the second pulse width; or a module configured to adjust the drive signal frequency of the electronic horn according to the first frequency, and then perform pulse width adjustment on the drive signal after the frequency adjustment according to the first pulse width and the third pulse width; or a module configured to adjust the drive signal frequency of the electronic horn according to the second frequency, and then perform pulse width adjustment on the drive signal after the frequency adjustment according to the second pulse width and the third pulse width; or a module configured to adjust the drive signal frequency of the electronic horn according to the first frequency and the second frequency, and then perform pulse width adjustment on the drive signal after the frequency adjustment according to the first pulse width, the second pulse width and the third pulse width.

9. The intelligent electronic horn according to claim 5, further comprising:

an analog-to-digital conversion module, configured to convert the detection result from an electrical signal to a digital signal for use in calculating the compensation control parameter.

10. The intelligent electronic horn according to claim 5, further comprising:

a power amplification module, configured to perform power amplification on the drive signal after the compensation control, and use the drive signal after the power amplification to drive the electronic horn to sound.

* * * * *